United States Patent [19]

Frank et al.

[11] Patent Number: 4,592,670

[45] Date of Patent: Jun. 3, 1986

[54] ANGULAR MOTION PAPER FEED RELEASE SYSTEM

[75] Inventors: Edgar H. Frank; Steven R. Komplin, both of Lexington, Ky.

[73] Assignee: International Business Machines Corporation, Armonk, N.Y.

[21] Appl. No.: 626,362

[22] Filed: Jun. 29, 1984

[51] Int. Cl.[4] ..... B41J 13/048

[52] U.S. Cl. ..... 400/637.6; 400/637

[58] Field of Search ..... 400/632, 637.6, 708, 400/708.1; 101/232, 228, 247

[56] References Cited

U.S. PATENT DOCUMENTS

| | | | |
|---|---|---|---|
| 2,939,389 | 6/1960 | Toemba | 101/247 |
| 3,581,861 | 6/1971 | Bellis | 400/637.2 |
| 3,714,893 | 2/1973 | Cole | 101/228 |
| 4,221,489 | 9/1980 | Engle et al. | 400/637.5 |
| 4,342,521 | 8/1982 | Kuhn | 400/637 |
| 4,364,683 | 12/1982 | Shakib et al. | 400/637 |
| 4,437,780 | 3/1984 | Weber et al. | 400/637.1 |
| 4,549,826 | 10/1985 | Stoeberl | 400/708 |

FOREIGN PATENT DOCUMENTS

| | | | |
|---|---|---|---|
| 108388 | 5/1984 | European Pat. Off. | 400/708.1 |

*Primary Examiner*—William Pieprz

*Attorney, Agent, or Firm*—Laurence R. Letson

[57] ABSTRACT

A paper feed release system is disclosed wherein a camming member is mounted on and acts with respect to the platen shaft to depress a paper feed release bar extending entirely across the paper feed mechanism such that only one end of said bar is depressed while the second end provides a pivot with respect to the frame supporting the paper feed mechanism. The paper feed rolls and shafts are supported on support plates which are engaged by the paper feed release bar and are caused to be depressed by the pivoting movement of the paper feed release bar with respect to the frame member, under the influence of the camming release member.

11 Claims, 5 Drawing Figures

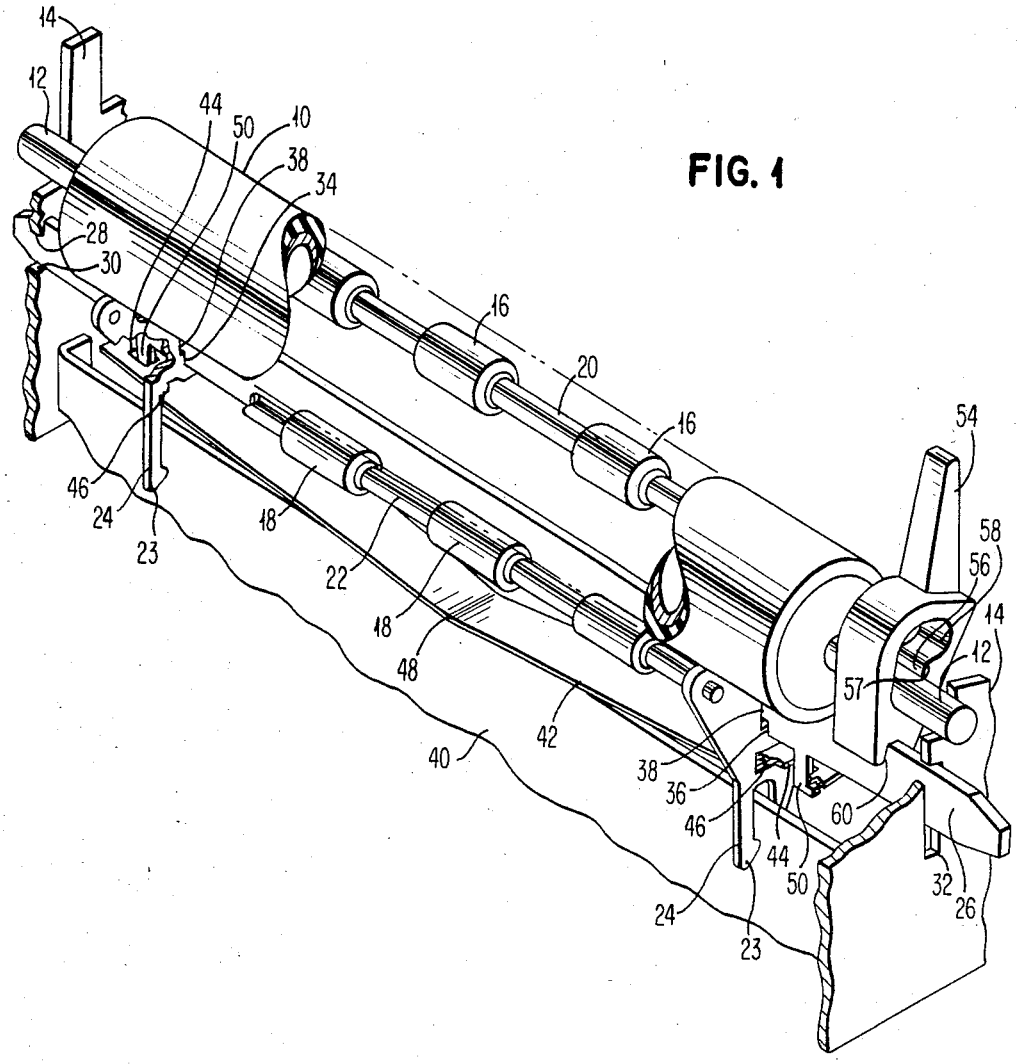
FIG. 1
FIG. 2
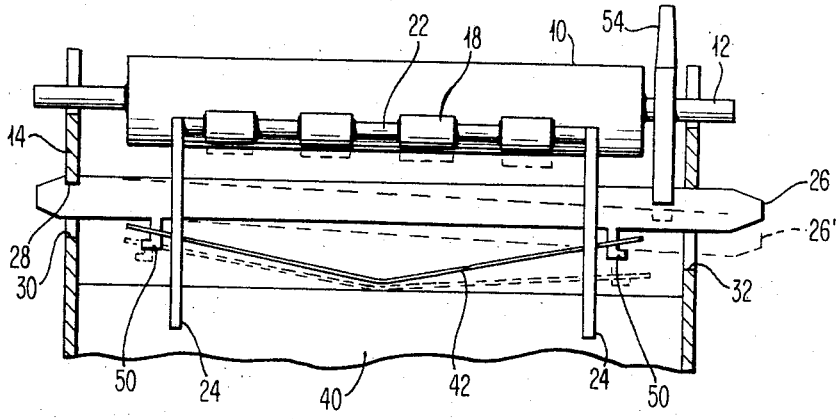

ANGULAR MOTION PAPER FEED RELEASE SYSTEM

FIELD OF THE INVENTION

This invention relates to typewriter and printer paper feeds and particularly to the pressure feed roll/rotary platen type of paper feeds.

BACKGROUND OF THE INVENTION

The simplification of paper feeds is a goal in the design of any typewriter or printer, so long as they may be simplified without reducing reliability in feeding the paper. In an effort to simplify paper feed, a self-aligning and non-adjustable paper feed mechanism is of primary interest. The self-alignment eliminates the need for precise positioning of the paper feed assembly while non-adjustable paper feeds eliminate the expense of manufacturing the adjustment capacity into the paper feed and the expense of performing the adjustments. Simple release controls eliminate assembly problems and thereby tend to reduce manufacturing and assembly costs. The need for a simpler mechanism is dictated by costs and reliability together with the need to automate the assembly of apparatus such as typewriters and printers to be cost effective in the marketplace.

A self-aligning paper feed for a typewriter is disclosed in U.S. Pat. No. 4,364,683 to I. D. Shakib et al. The release of the paper feed disclosed in the Shakib et al patent depends upon the release bail engaging a release surface and pulling the feed roll assembly away from the platen to allow insertion of the paper or movement of the paper with respect to the platen.

The paper feed of the Epson MX80F/T printer is one where a bail has coaxially mounted thereon a pair of feed rolls spaced apart slightly and positioned roughly at the mid point of the bail. The bail is pulled by a spring into a slot in the frame and maintained in that position by a spring. The end of the slot acts as a fulcrum for the bail while the opposite end of the bail is engaged by a control lever and can be forced generally radially outward from the platen axis. With the movement outward, the feed rolls, being mounted at approximately the midpoint of the bail, will then move outward, also in a generally radial direction from the axis of the platen by approximately half the distance the free end of the bail is translated. One disadvantage of this type paper feed is that the feed rolls will have a tendency to exert an uneven force on the platen depending upon the thickness of the paper being fed and particularly when multiple-part forms are being fed. A further disadvantage of this system is that there is no self-aligning capability.

SUMMARY OF THE INVENTION

A self-aligning feed roll assembly is supported on a feed roll bar such that the feed roll bar may be lowered at one end to relieve the engagement between the feed rolls, on the feed roll assembly, and the periphery of the platen and thereby release paper from the printer.

The movement of the paper feed bar is accomplished by a camming member with the cam surface engaging the platen shaft thereby moving the cam generally downward in response to the camming member being pulled forward by the operator. The downward movement of the cam pushes the paper feed bar down and away from the platen, thus relieving the feed roll assembly from the surface of the platen by lowering it.

DRAWING

FIG. 1 is a partially cutaway perspective view of the paper feed assembly.

FIG. 2 is a front view of the paper feed assembly showing the paper feed rolls, the paper feed roll assembly, the paper feed bar, and the engaged and the withdrawn positions.

DESCRIPTION OF THE INVENTION

Figure 3:
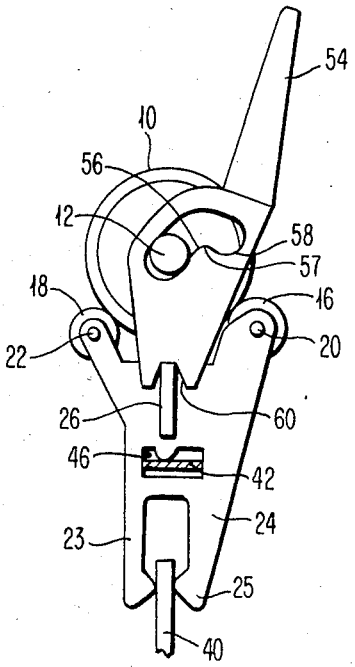
FIG. 3 is an end view of the paper feed assembly in the engaged position.

Referring to FIG. 1, which is a partial cutaway view of the paper feed mechanism, a platen 10 is positioned such that platen shaft 12 is supported by frame 14. Frame 14 provides the rigid support necessary to precisely position platen 10 relative to the remainder of the typewriter or printer.

In order to provide the forces necessary to increment the paper about the platen, feed rolls 16, 18 are biasingly engaged with the periphery of the platen 10 on the lower portion of the platen's periphery. Rear feed rolls 16 and front feed rolls 18 are rotatably supported and affixed to shaft 20 and 22, respectively.

To maintain the feed roll shafts 20 and 22 in parallelism, feed roll plates 24 are provided, one of which engages each end of feed roll shafts 20 and 22. Feed roll plates 24 act as supports for the feed roll shafts 20, 22 and at the same time transmit forces to the feed roll shafts 20, 22 to cause the engagement of feed rolls 16, 18 with the periphery of the platen 10. Feed roll plates 24 are maintained at the appropriate spaced apart distance and orientation by paper feed bar 26. Paper feed bar 26 extends entirely across the typewriter or printer and through the frame members 14. Near one end of the paper feed bar 26, a notch 28 (best seen in FIG. 2) is formed on the upper surface thereof for engaging the frame member 14. The notch 28 insures that bar 26 will be laterally positioned appropriately with respect to the frame 14. The bar 26 extends through the frame opening 30 sufficiently to engage notch 28 with frame 14. The opposite end of the paper feed bar 26 extends through a similar but longer dimensioned frame opening 32. The need for the longer dimension is to accommodate downward movement of the paper feed bar 26.

To retain the feed roll plates 24 in the proper lateral position to retain and support the feed roll shafts 20, 22, the paper feed bar 26 is notched at 34 and 36 (FIG. 1). The notches 34 and 36 fit down over mating notches 38 on the feed roll plate 24. The mating of the notches 34, 36 on the paper feed bar 26, with the notches 38 on the feed roll plates, acts to restrain the feed roll plates 24 from lateral movement in any direction along bar 26, thus keeping the feed roll shafts 20 and 22 properly engaged with the platen 10 and keeping the paper feed roll assembly positioned with respect to the platen 10. It should be noted that the notch 36 formed into the paper feed bar 26 is substantially longer than the notch 34. This differenoe in the dimension is to allow some downward movement of paper feed bar 26 prior to the interferring engagement with feed roll plate 24. The dimension of notch 36 may be configured such that engagement with the feed roll plate 24 occurs at substantially the same time as or after engagement of notch 34 with paper feed roll plate 24, thereby causing a release of the engagement between the feed rolls 16 and 18 from the periphery of the platen 10 at approximately the same time.

Figure 4:
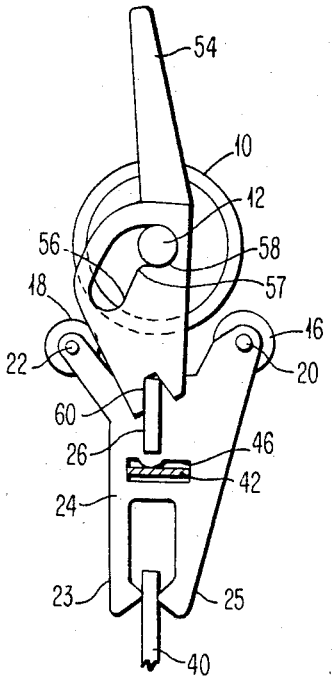
FIG. 4 is an end view of the paper feed assembly with the paper feed roll assembly in its withdrawn position.
Figure 5:
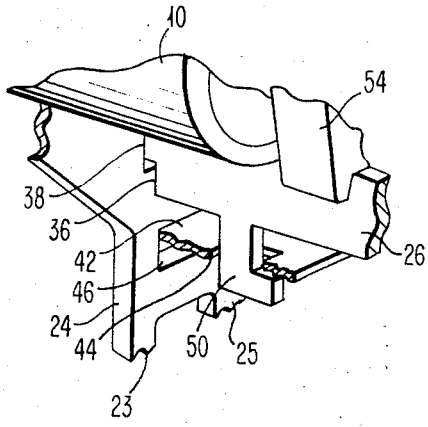
FIG. 5 is an enlarged perspective view of the portion of the paper feed bar which engages the paper feed roll assembly.

Feed roll plates 24 have a bifurcated lower end thus forming a pair of fingers 23 and 25 (FIG. 3 and FIG. 4). These fingers 23, 25 extend down over a plate 40 which extends between and is supported by frame members 14. Plate 40 provides the structure against which force may be exerted to cause the biasing of the feed roll plates 24 to raise plates 24 toward platen 10.

To provide this raising force, which positions the feed roll plates 24 adjacent the periphery of platen 10, a centrally bent leaf spring 42 is provided. Spring 42 is configured with two holes 44 near the ends thereof. The ends of spring 42 are inserted through apertures or holes 46 in feed roll plates 24 and will tend, due to the bend 48, to flex the ends upward engaging the upper surface of hole 46. Thus, the spring 42 will act to push the feed roll plates 24 upward, transmitting that bias to the feed rolls 16 and 18 until they engage the periphery of platen 10.

Since there are no permanent fasteners involved in the assembly, it is necessary to be able to assemble the feed roll assembly and the paper feed bar 26 in such a way it will remain assembled during handling so that the total subassembly may be positioned in the machine either manually or by automated mechanical assembly means. In order to retain the assembly in its assembled condition, paper feed bar 26 is formed with outward dog leg or L-shaped extensions 50 depending from paper feed bar 26 near the ends of the bar 26 and spaced approximately the same distance as are the holes 44 in spring 42. Thus, after spring 42 has been inserted through the holes 46 in the feed roll plate 24, the paper feed bar 26 may be positioned onto the feed roll plates 24, engaging the notches 38, and the spring 42 flexed to insert the L-shaped appendages 50 through the holes 44. With the spring 42 relaxed, the holes 44 will be retracted until the holes 44 are incapable of slipping over the L-shaped appendage 50 and thus will retain the paper feed bar 26, the feed roll plates 24 and the feed roll shafts 20 and 22 in assembly.

To assemble the paper feed assembly into the typewriter frame 14, the rightmost end as viewed in FIG. 1 of paper feed bar 26 is inserted into the hole 32 in frame 14 to a sufficient distance to permit the leftmost end of bar 26 to be located within frame 14 and to be aligned with hole 30. When the leftmost end of bar 26 is aligned with hole 30, it is then inserted into hole 30 until notch 28 engages frame 14 at the leftmost end of bar 26. In so doing, fingers 23, 25 of the feed roll plates 24 are positioned astradle plate 40. As the assembly is lowered over plate 40, spring 42 will engage plate 40 in the region of the bend 48 thus flexing the spring 42 upward. After paper feed bar 26 is positioned in its previously described position, the platen 10 may be inserted into frame 14.

In order to retract paper feed bar 26 from platen 10, a simplified paper feed release lever 54 is provided to act in conjunction with the platen shaft 12. Release lever 54 is formed to include not only a handle or other manual control element but also a camming surface 56 formed interiorly thereof. Camming surface 56 is oriented such that a forward pull of the lever 54 against platen shaft 12 will overcome spring 42 and cause a relatively downward movement of lever 54 with respect to shaft 12 (FIG. 4). After the lever 54 has moved downward sufficiently, detent shaft 12 will clear cam 56 at point 57 and shaft 12 will then be positioned in the detenting depression 58. The vertical component of movement of lever 54 is transmitted to paper feed bar 26 by the engagement between notch 60 at the bottom of lever 54 and paper feed bar 26.

Notch 60 insures that the paper feed release lever 54 remains in engagement with paper feed bar 26.

The release of the paper feed assembly by withdrawing the paper feed rolls 16, 18 from engagement with the platen 10 may be continued on an indefinite basis by leaving the paper feed lever 54 in its detented forward position with shaft 12 engaged in the detenting depression 58. This insures that the distance between the top of the paper feed bar 26 and the platen shaft 12 is at its maximum stable distance.

The release of the paper feed assembly may be accomplished by the pushing backward of the paper feed release lever 54 to restore it to an undetented position relative to shaft 12 and allow the spring 42 to urge the paper feed plates 24 upward in response to the flexing of spring 42.

A further improvement for the engagement of spring 42 with the upper surface forming the hole 46 in feed roll plate 24 is the formation of a rounded area depending from holes 46 to form a localized or point bearing surface 70. The bearing surface 70 engaging the spring 42 permits a more even distribution of force between feed rolls 16, 18 and the platen 10, together with an improved self-alignment of the feed roll assembly.

The operation of the entire paper feed release mechanism described above may be best seen in FIG. 2. When paper feed release lever 54 is moved forward (toward the operator), the camming surface 56 causes a downward movement of lever 54 with respect to shaft 12. This downward movement forces the paper feed bar 26 to a displaced position 26' shown in dashed lines. As the paper feed bar 26 rotates downward, its engagement with feed roll plates 24 as has been described above, will cause the paper feed roll plates 24 to likewise move downward. As they are moved downward, they will pull the feed roll shafts 22 and feed rolls 18 downward away from the periphery of platen 10. Likewise, the feed roll shaft 20 and feed rolls 16, not visible in FIG. 2, will be pulled downward and out of engagement with the periphery of platen 10. Flexure of spring 42 due to the downward movement of feed roll plates 24 will store energy in spring 42 sufficient to restore feed roll plates 24, feed roll shaft 20 and 22 and feed rolls 16 and 18 to their raised position upon the return of paper feed release lever 54 to its rearward position. Notch 28 serves as a pivot in conjunction with frame 14.

Operation of paper feed release lever 54 forward positively retracts the feed rolls 16, 18 from the platen 10 and the release of paper feed release lever 54 to its rearward position allows the spring 42 to bias the entire assembly upward until the feed rolls 16, 18 engage platen 10. The paper feed roll assembly may be subassembled and then inserted in one operation into the frame 14 of the typewriter. Removal of the platen 10 from the typewriter will only allow such upward movement of the assembly as is permitted by the holes 30 and 32 inside frame 14. Thus, the assembly may not unintentionally become disengaged from the frame 14 upon the removal of the platen. This assembly will minimize parts and simplify assembly of the typewriter or printer, thereby reducing the cost and making the apparatus more reliable.

We claim:

1. A paper feed for a printer, comprising:

a platen having a platen shaft and a axis of rotation;

support frame members spaced apart for supporting said platen;

said support frame members defining slots therein below said platen shaft;

a member extending through said slots and parallel to said platen axis;

one of said slots in said support frame defining a pivot for said member;

support means for supporting feed rolls, said support means supported on said member;

said feed rolls engageable with said platen;

release means comprising a lever and cam surface, said cam surface acting against said platen shaft, for moving said member from a first position in the other of said slots to a position displaced from said first position and said platen while pivoting said member in said one of said slots to relieve engagement of said feed rolls with said platen.

2. The paper feed of claim 1 also comprising a bowed leaf spring, each end of said leaf spring engaging said support means and biasing said engaged support means toward said platen.

3. The paper feed of claim 2 in which said support means have an aperture with a depending part, said aperture receiving said leaf spring and engaging said leaf spring by said depending part to provide localized contact.

4. A paper feed for a printer having a platen, comprising:

spaced frame members of said printer, at least one feed roll shaft carrying feed rolls, two plate members, one positioned on each end of said feed roll shaft and supporting said feed roll shaft, a control member engaging said members and extending across said speced frame members, and manual means comprising a lever and cam surface, said cam surface surface acting against said platen, to rotate said control member on one of said frame members to rotate said plates away from said platen to release paper from said platen and to rotate said plates toward said platen to permit paper feed.

5. The paper feed as in claim 4 also comprising spring means biasing said plate members toward said platen and wherein said manual means comprises camming means to move said control member by overcoming said spring means.

6. The paper feed as in claim 5 in which said plate members and said control member have mating notches by which they engage and are held in position under said bias of said spring means.

7. The paper feed as in claim 5 in which said at least one feed roll shaft comprises two, spaced apart feed roll shafts carrying feed rolls.

8. The paper feed as in claim 7 in which said control member is engaged and held in position with said frame member by a notch in one of them, said frame members having slots to permit said rotation.

9. The paper feed as in claim 8 in which said support plates have fingers on each side of a fixed plate to guide said plates while permitting said rotation.

10. The paper feed as in claim 9 in which said spring means is a bowed leaf spring, one end of said leaf spring extending through an aperture with a depending part in one of said support plates and the other end of said leaf spring extending through an aperture with a depending part in the other of said support plates, said leaf spring engaging said plates by said depending parts to provide localized contact.

11. The paper feed as in claim 4 in which said spring means is a bowed leaf spring, one end of said leaf spring extending through an aperture with a depending part in one of said support plates and the other end of said leaf spring extending through an aperture with a depending part in the other of said support plates, said leaf spring engaging said plates by said depending parts to provide localized contact.

* * * * *